US006558135B1

(12) United States Patent
Wood

(10) Patent No.: US 6,558,135 B1
(45) **Date of Patent: *May 6, 2003**

(54) TWO STAGE OIL FREE AIR COMPRESSOR

(75) Inventor: Mark W. Wood, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 101 days.

This patent is subject to a terminal disclaimer.

(21) Appl. No.: 09/776,236

(22) Filed: Feb. 2, 2001

Related U.S. Application Data

(63) Continuation-in-part of application No. 09/247,705, filed on Feb. 9, 1999, now Pat. No. 6,183,211.

(51) Int. Cl.[7] ..... D06F 75/24

(52) U.S. Cl. ..... 417/254; 417/246

(58) Field of Search ..... 417/524

(56) References Cited

U.S. PATENT DOCUMENTS 6,183,211 B1 * 2/2001 Wood ..... 417/254

* cited by examiner

*Primary Examiner*—Teresa Walberg
*Assistant Examiner*—L Fastovsky
(74) *Attorney, Agent, or Firm*—Suiter & Associates PC

(57) ABSTRACT

A two stage reciprocating piston oil free air compressor having an improved service interval. In a first stage, a first wobble piston is reciprocated in a first cylinder to compress ambient air to an intermediate pressure. In a second stage a second wobble piston is reciprocated in a second cylinder to compress the intermediate pressure air to a desired high pressure. Each wobble piston is provided with a seal which seals to the adjacent cylinder walls as the piston reciprocates and rocks. The stroke of the higher pressure second stage piston is less than the stroke of the lower pressure first stage piston to increase the operating life of the second seal, preferably to substantially the same operating life as the first seal.

5 Claims, 1 Drawing Sheet

TWO STAGE OIL FREE AIR COMPRESSOR

CROSS-REFERENCE TO RELATED APPLICATIONS

The present application is a continuation-in-part of U.S. application Ser. No. 09/247,705 filed Feb. 9, 1999 now U.S. Pat. No. 6,183,211.

The entire disclosure of U.S. application Ser. No. 09/247,705 filed Feb. 9, 1999 is considered to be part of the disclosure of the present application and is hereby incorporated by reference in its entirety.

FIELD OF THE INVENTION

The present invention relates generally to the field of gas compressors and more specifically to a two stage oil free compressor.

BACKGROUND OF THE INVENTION

Two different construction designs are commonly used for reciprocating piston air compressors. According to one design, a generally cylindrical shaped piston is constrained to slide in a cylinder. A connecting rod is secured at one end to the piston with a wrist pin to permit rotation between the piston and the connecting rod. An opposite end of the connecting rod is secured to be rotated by a crank pin on a motor driven crank shaft or on an eccentric. As the crank pin is rotated, the connecting rod converts the rotary motion to reciprocate the piston. The piston is provided with one or more piston rings to form a sliding seal between the piston and the wall of the cylinder to prevent gas leakage from a compression chamber formed by the cylinder and piston. In order to minimize friction and wear, the connecting rod connections and the cylinder walls and piston rings must be constantly lubricated during operation. Consequently, oil is provided to lubricate these surfaces during operation of the compressor. One disadvantage with an oil lubricated air compressor is that some oil may pass between the cylinder walls and the sliding piston ring seals into the compression chamber. Any oil which enters the compression chamber will mix with the compressed air. For some applications, it is undesirable to have any oil mixed with the air. For example, when using compressed air to operate a paint spray gun, any oil in the air may adversely affect the quality of the applied paint. Also, oil in the compressed air may be undesirable when the compressed air is used with a dusting gun.

When higher air pressures are needed, air compressors frequently are provided with two stages of compression, i.e., with two cylinders. A first stage compresses the air to an intermediate pressure and a second stage increases the intermediate pressure air to a desired higher level. Since the air delivered from the first stage to the second stage is partially compressed and has a smaller volume than the air initially delivered to the first stage, the second stage will have a smaller displacement than the first stage. This generally has been accomplished by making the diameter of the second stage piston smaller than the piston diameter for the first stage. Normally, the crank shaft provides the same stroke length for the two pistons. In U.S. Pat. No. 1,067,770 to Spohrer, it was recognized that when the second stage piston was made significantly smaller than the first stage piston, the bearing size for the connecting rod bearing surfaces at the piston also had to be made significantly smaller. Since the bearings in the second stage are subjected to higher pressures in than in the first stage, the smaller bearing size could result in excessive wear and premature bearing failure. According to Spohrer, this problem could be overcome where the second stage was provided with a shorter piston stroke than the first stage and the diameter of the second stage piston was increased to retain the desired displacement. Although the second stage piston remained smaller than the first stage piston, the increased diameter of the second stage piston permitted the use of a larger bearing between the connecting rod and the second stage piston so as to prolong bearing life.

A second design for reciprocating piston air compressors does not require oil lubrication. In an oil free compressor, the piston consists of a connecting rod and a piston head formed as a single integral unit so that there is no rotation between the connecting rod and the piston head. A free end on the connecting rod is connected to be rotated by a crank pin on a motor driven crank shaft or other eccentric. The piston head has a smaller diameter than a cylinder in which it is reciprocated to permit the piston head to rock or wobble in the cylinder, since the connecting rod and piston head are integral. A flexible cup shaped seal is secured to the piston head to seal with the walls of the cylinder as the piston head is reciprocated and wobbles. Oil free air compressors have the advantage over oil lubricated air compressors in that oil will not leak past the seal where it can mix with the compressed air. However, they have a disadvantage in that the cup shaped seal has a more limited operating life than oil lubricated piston rings. The seal life is determined in part by the air pressure applied to the seal and by the velocity and the distance the seal travels in each stroke. As the pressure increases, the seal is pressed tighter against the walls of the cylinder. Consequently, the seal is subjected to greater wear at higher compression pressures.

Two stage oil free air compressors have been attempted in the past. These have been constructed with pistons of the type having a connecting rod connected to the piston with a wrist pin. It is believed that these compressors were operated at a relatively slow speed in order to extend the life of the piston ring seals. Although single stage wobble piston oil free air compressors have been highly successful, two stage wobble piston oil free air compressors have not been made due to excessive wear on the second stage seal. The second stage seal would require replacement long before replacement is needed for the first stage seal. Consequently, higher pressure reciprocating piston air compressors have not been of the oil free wobble piston type.

SUMMARY OF THE INVENTION

Accordingly, the present invention is directed to a two stage oil free reciprocating piston compressor for air or another gas. Each compression stage includes a wobble piston having a seal which prevents gas leakage between the piston and the walls of a cylinder in which the piston reciprocates. According to a preferred embodiment of the invention, the length of the stroke of the second stage piston is shorter than the length of the stroke for the first stage piston so that the seal life for the second stage is significantly increased, preferable to at least substantially the same life as the first stage seal. By shortening the stroke length for the higher pressure second stage, both the distance traveled by the seal and the maximum velocity of the seal are reduced from the distance traveled and maximum velocity for the first stage seal. This in turn increases the operating life of the second stage seal to compensate for the greater wear caused by the higher operating pressures. As the stroke length is decreased, the diameters of the second stage, piston head, and seal are increased over their diameters when both pistons have the same stroke length to maintain the desired displacement for the second stage. Preferably, a stroke length is selected for the second stage which will provide at least substantially the same seal life as that obtained from the lower pressure first stage seal in order to maximize the maintenance cycle for the air compressor.

Accordingly, it is an object of the invention to provide a two stage oil free gas compressor.

In a preferred embodiment, it is a further object of the invention to provide a two stage oil free air compressor in which the operating life for the higher pressure second stage piston seal in increased, preferably to substantially the same operating life as the first stage seal.

Other objects and advantages of the invention will become apparent from the following detailed description of the invention and the accompanying drawings.

DETAILED DESCRIPTION OF THE INVENTION

Reference will now be made in detail to a presently preferred embodiment of the invention, and example of which is illustrated in the accompanying drawings.

Figure 1:
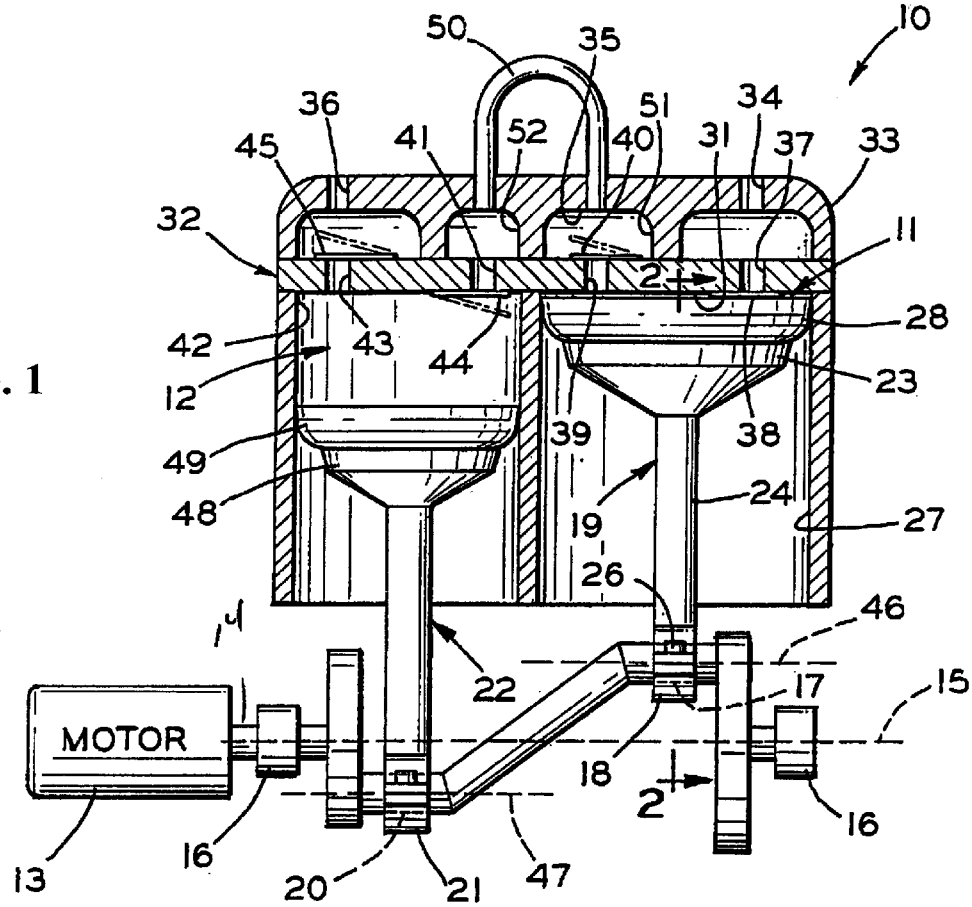
FIG. 1 is a diagrammatic cross sectional view through a two stage, oil free air compressor according to the invention.

Referring to FIG. 1, a diagrammatic cross sectional view is shown for a two stage, oil free air compressor 10 according to the invention. Although the compressor 10 is described in its preferred embodiment as an air compressor, it will be appreciated that the compressor 10 may be used for compressing other types of gas without departing from the scope of the invention. As used herein, an "oil free compressor" is intended to mean a reciprocating piston gas compressor of the type having a wobble piston in which the piston head and connecting rod are integral and which has a cup shaped seal secured to the piston head. The air compressor 10 includes a first stage 11 which takes ambient air and compresses it to an intermediate pressure, and a second stage 12 which takes the intermediate pressure output from the first stage and compresses it to a desired high pressure.

Figure 2:
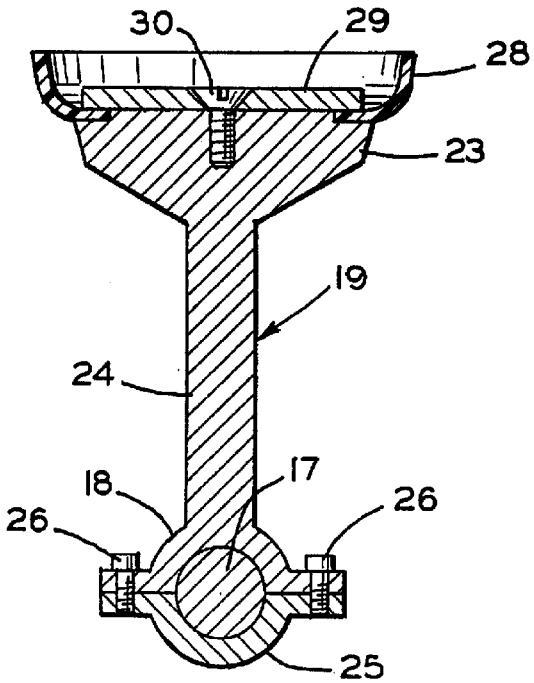
FIG. 2 is a cross sectional view through a piston as taken along line 2—2 of FIG. 1.

A motor 13 is connected to rotate an eccentric or a crank shaft 14 about an axis 15. The crank shaft 14 is supported by a plurality of bearings 16. The shaft 14 has a first crank pin 17 on which an end 18 of a first wobble piston 19 is secured to rotate and a second crank pin 20 on which an end 21 of a second wobble piston 22 is secured to rotate. The first wobble piston 19 has an enlarged diameter head 23 which is integrally formed with a connecting rod 24, as best seen in FIG. 2. The connecting rod 24 extends between the piston head 23 and the end 18 which is connected to the first crank pin 17. The connecting rod end 18 may be connected to the eccentric 17 by any known method, for example, with a clamp 25 which is secured to the piston end 18 with two bolts 26. A bearing (not shown) may be provided between the connecting rod end 18 and the crank pin 17.

The piston head 23 of the first piston 19 is of a slightly smaller diameter than the diameter of a first cylinder 27 in which the piston head 23 reciprocates to permit the piston head 23 to rock or wobble as it is reciprocated. A first cup shaped seal 28 is clamped to the piston head 23 with a plate 29 and a screw 30 which passes through the plate 29 and engages the piston head 23. The seal 28 may be formed from various known low friction materials, such as polytetrafluoroethylene, or a polytetrafluoroethylene filled with a lubricant such as brass or graphite. The material forming the seal 28 must be sufficiently resilient to maintain a seal with the cylinder 27 as the piston head reciprocates and wobbles or rocks in the cylinder 27.

A first compression chamber 31 is formed between the cylinder, the piston head 23 and a valve plate 32. The valve plate 32 is clamped between the cylinder 27 and a head 33 which includes an ambient air inlet 34, a passage 35 for delivering intermediate pressure air from the first compression stage 11 to the second compression stage 12, and a pressurized air outlet 36. The valve plate 32 includes a first intake port 37 and a first intake check valve 38 which controls the flow of ambient air from the ambient air inlet 34 through the first intake port 37 into the compression chamber 31 during an intake stroke of the first piston 19. If desired, air drawn into the inlet 34 may be filtered. The valve plate 32 also has a first outlet port 39 and a first outlet check valve 40 for delivering compressed air from the compression chamber 31 through the outlet port 39 to the passage 35.

The valve plate 32 also has a second intake port 41 connecting between the passage 35 and a second stage compression chamber 42, and a second outlet port 43 connecting between the second stage compression chamber 42 and the compressed air outlet 36. A second intake check valve 44 is mounted on the valve plate 32 to limit air flow from the passage 35 through the second intake port 41 to the second stage compression chamber 42 and a second outlet check valve 45 is mounted on the valve plate 32 to limit air flow from the second stage compression chamber 42 through the second outlet port 43 to the compressed air outlet 36. The valves 38, 40, 44 and 45 are illustrated as reed valves mounted on the valve plate 32 to deflect away from the ports 37, 39, 41 and 43, respectively, (as shown by dashed lines) when air is drawn or forced through the ports. However, it will be appreciated that other well known valve plate and valve constructions may be used. Also, the single valve plate 32 may be replaced with separate valve plates for each compressor stage, or the valve plate may be eliminated and valves may be mounted on the head 33.

The passage 35 may be located in the head 33, or between the head 33 and the valve plate, or, preferably, it includes a tube 50 which connects between a first stage outlet chamber 51 in the head 33 and a second stage intake chamber 52 in the head 33, as shown. Frequently, the motor 13 also drives a cooling fan (not shown) for cooling the motor 13 and the cylinders and the head 33. Preferably, a flow of cooling air from the fan is directed over a coil of the tube 50 to reduce the temperature of the intermediate pressure air delivered to the second compression stage. If, for example, the intermediate pressure air from the first stage is at about 300° F. (149° C.), its temperature may be dropped to about 200° F. (93° C.) before it enters the second stage compression chamber 42.

The crank pins 17 and 20 on the crank shaft 14 are preferably displaced from each other by 180 degrees about the crank shaft axis of rotation 15. Consequently, as the first piston 19 is moving upwardly on its compression stroke to compress air, the compressed air flows through the outlet port 39, the passage 35 and the intake port 41 to the second stage 12 while the second stage piston 22 is simultaneously moving downwardly on its intake stroke. While the first stage piston 19 is moving downwardly on its intake stroke, the second stage piston 22 is moving upwardly on its compression stroke to discharge high pressure compressed air through the outlet port 43 to the compressor outlet 36.

However, the crank pins 17 and 20 may be displaced from each other about the axis of rotation 15 by an angle other than 180 degrees. If the intermediate pressure air from the first stage does not flow immediately to the second stage, the passages between the first stage outlet port 39 and the second stage intake port 41 must have sufficient volume to accumulate the compressed gas from the first stage until it enters the second stage compression chamber 42.

The first crank pin 17 for the first piston 19 has an axis 46 which is offset from the axis of rotation 15 for the crank shaft 14, and the second crank pin 20 has an axis 47 which is offset from the axis of rotation 15 for the crank shaft 14. As indicated above, the axes 46 and 47 are preferably displaced 180 degrees apart about the axis of rotation 15. According to the invention, the spacing or offset between the axis 47 and the axis of rotation 15 is less than the spacing or offset between the axis 46 and the axis of rotation 15. The smaller offset for the second crank pin 20 produces a shorter stroke for a head 48 on the second piston 22 than the stroke for the head 23 on the first piston 19. A sliding cup shaped seal 49 is mounted on the second piston head 48 in a manner similar to the mounting of the seal 28 on the first piston head 23. If the piston heads 23 and 48 are reciprocated over the same length strokes, the second piston seal 49 will have significantly greater wear and a significantly shorter operating life than the first piston seal 28. The increased wear is a result of the substantially higher gas pressure exerted on the second stage seal 49 than on the first stage seal 28.

If the seals 28 and 49 are of the same materials and are subjected to the same gas pressure, it has been found that the primary factors affecting seal life are the maximum seal velocity and the length of the reciprocation stroke. As the stroke length and maximum velocity are decreased, the seal life will increase. Thus, by shortening the length of the stroke for the second piston 22, the life of the second piston seal 49 will increase. The maintenance cycle for the compressor 10 will be maximum if the strokes are set so that the seals 28 and 49 simultaneously reach the ends of their operating lives.

In order to ensure that the compression ratio in each stage is substantially similar, the displacement for the second stage may be calculated which depends on the absolute pressure of intake gas for the first stage, the absolute pressure for the exhaust gas for the second stage, and the displacement of the first stage. The displacement in the second stage cylinder may be calculated as shown below:

$$D2 = D1 \Big/ \left(\frac{\sqrt{P2*P1}}{P1}\right) \wedge \frac{1}{n}$$

where:

D2=displacement of second stage in cubic inches per revolution;

D1=displacement of first stage in cubic inches per revolution;

P1=absolute pressure of intake gas for the first stage in pounds per square inch;

P2=absolute pressure of exhaust gas for the second stage in pounds per square inch; and n=polytropic compression exponent where pressure times velocity raised to the nth power is constant.

Utilizing the equation as shown above, the displacement in the second stage may be calculated. In order to achieve similar compression ratios for the first stage and the second stage, the displacement in the second stage is reduced. In two stage oil free compressors known to the art, the bore of the second stage cylinder is reduced.

The advantage of the two stage oil free air compressor of the present invention is the ability to reduce wear. In an exemplary embodiment, a reduction in the stroke length of the high pressure second stage in regards to the stroke of the first stage may result in an increase in the seal life of the second stage. Wear or degradation of the seals is proportional to the pressure in the cylinder and the velocity of the piston. As the pressure of the cylinder and the velocity of the piston are increased, the seal life will be reduced. Since the pressure of the cylinder in the first stage is less than the pressure of the cylinder in the second stage, the piston seal of the first stage has a longer working life than the seal of the piston seal of the second stage.

In order to reduce wear, velocity of the piston may be reduced in order to extend the life of piston seals. By reducing the stroke, an increase in the working life of the piston seal may be accomplished. However, in order to maximize the maintenance cycle of a two stage oil free compressor, it is desirable that the piston seal for the first stage and the piston seal for the second stage end the working life at approximately the same time, hence both seals may be replaced at or near the same time.

In order to determine the stroke for the second stage, the displacement of the second stage calculated previously may be used along with the bore of the second stage to calculate the stroke for the second stage.

$$S2 = D2 * \frac{4 * B2 \wedge 2}{P}$$

where:

S2=stroke of second stage;

D2=displacement of second stage in cubic inches per revolution;

B2=bore of second stage cylinder; and

P=the constant 3.1417 approximately equal to the ratio of circumference to diameter of a circle.

Utilizing the equation as shown above, the stroke for the second stage may be calculated which may maximize the maintenance cycle for the two stage oil free compressor. Further, the bore of the second stage need not be reduced in order to achieve less displacement in the second stage as required to arrive at similar compression ratios for the first stage and the second stage.

Upon calculation of the stroke for the second stage, a proper weight for the second piston may be determined in order to achieve optimal balancing of a ninety degree two cylinder reciprocating compressor with both eccentrics in phase and different strokes for the two pistons.

$$PW2 = \frac{PW1 * S1}{S2}$$

where:

PW2=weight of the second stage piston;

PW1=weight of the first stage piston;

S1=stroke of the first stage piston; and

S2=stroke of the second stage piston.

It will be appreciated that various changes may be made to the above described preferred embodiment of a two stage oil free reciprocating piston gas compressor without departing from the scope of the following claims. Although specific constructions were illustrated for the components of the compressor 10, it should be appreciated that components of other known constructions used in reciprocating wobble piston oil free gas compressors may also be used without departing from the invention.

What is claimed is:

1. A two stage oil free compressor assembly, comprising:

(a) a first compression stage including a first piston connected to reciprocate in a first cylinder suitable for compressing gas from a low pressure to an intermediate pressure;

(b) a second compression stage including a second piston connected to reciprocate in a second cylinder suitable for compressing gas from an intermediate pressure to a higher pressure;

(c) a first seal placed between said first piston and said first cylinder;

(d) a second seal placed between said second piston and said second cylinder; and (e) means for reciprocating said first and second pistons a predetermined distance, wherein said second piston travels a second stroke length less than a first stroke length travelled by said first piston suitable for reducing wear on said second seal.

2. The two stage oil free compressor as claimed in claim 1, wherein said second stroke length of said second piston is a length wherein an expected wear life of said first seal and said second seal are substantially similar.

3. A method of extending the maintenance cycle for a two stage oil free compressor, comprising:

(a) compressing gas from a low pressure to an intermediate pressure in a first compression stage, said first compression stage including a first piston with a first seal, said first piston reciprocating a first length; and (b) compressing gas from an intermediate pressure to a high pressure in a second compression stage, said second compression stage including a second piston with a second seal, said second piston reciprocating a second length, wherein said first length and second length are adjusted relative to each other to maintain substantially equal compression ratios for the first and second stage while ensuring an expected wear life for said first and second seal are substantially the same.

4. The method as claimed in claim 3, wherein said first length and second length provide the desired output pressure.

5. A method of reducing wear on a seal of a second stage piston of a two stage oil free compressor assembly, comprising:

(a) providing an oil free compressor having a first compression stage adapted for compressing gas from a low pressure to an intermediate pressure and including a first wobble piston connected to reciprocate in a first cylinder and a first flexible seal between said first wobble piston and said first cylinder, a second compression stage adapted for compressing gas from the intermediate pressure to a higher pressure and including a second wobble piston connected to reciprocate in a second cylinder and a second flexible seal between said second wobble piston and said second cylinder, and a motor connected to reciprocate said first wobble piston in said first cylinder over a predetermined stroke and said second wobble piston in said second cylinder over a predetermined stroke; and (b) establishing a shorter predetermined stroke over which said second piston is reciprocated by said motor than said first piston is reciprocated by said motor so as to substantially equalize wear between said first and second flexible seal.

* * * * *